US011702729B2

(12) United States Patent
Debeaux et al.

(10) Patent No.: US 11,702,729 B2
(45) Date of Patent: Jul. 18, 2023

(54) METHOD FOR PRODUCING A STEEL STRIP WITH IMPROVED BONDING OF METALLIC HOT-DIP COATINGS

(71) Applicant: Salzgitter Flachstahl GmbH, Salzgitter (DE)

(72) Inventors: Marc Debeaux, Hildesheim (DE); Nils Köpper, Harsum (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 281 days.

(21) Appl. No.: 16/967,619

(22) PCT Filed: Jan. 30, 2019

(86) PCT No.: PCT/EP2019/052191
§ 371 (c)(1),
(2) Date: Aug. 5, 2020

(87) PCT Pub. No.: WO2019/154680
PCT Pub. Date: Aug. 15, 2019

(65) Prior Publication Data

US 2021/0156018 A1 May 27, 2021

(30) Foreign Application Priority Data

Feb. 6, 2018 (DE) ..... 102018102624.2

(51) Int. Cl.
*C23C 8/10* (2006.01)
*C23C 2/06* (2006.01)
(Continued)

(52) U.S. Cl.
CPC ..... *C23C 8/10* (2013.01); *C21D 9/561* (2013.01); *C21D 9/5732* (2013.01);
(Continued)

(58) Field of Classification Search
None
See application file for complete search history.

(56) References Cited

U.S. PATENT DOCUMENTS

2016/0102379 A1 4/2016 Makimizu et al.
2016/0304982 A1 10/2016 Makimizu et al.

FOREIGN PATENT DOCUMENTS

DE 102010037254 A1 3/2012
DE 102013105378 B3 8/2014
(Continued)

OTHER PUBLICATIONS

Preliminary Report on Patentability of the International Searching Authority in English from corresponding Patent Cooperation Treaty (PCT) Application No. PCT/EP2019/052191, completed Aug. 11, 2020.

(Continued)

*Primary Examiner* — Anthony M Liang
(74) *Attorney, Agent, or Firm* — Gardner, Linn, Burkhart & Ondersma

(57) ABSTRACT

A method for producing a steel strip containing, in addition to iron as the main component and unavoidable impurities, one or more of the following oxygen-affine elements in wt. %: Al: more than 0.02, Cr: more than 0.1, Mn: more than 1.3 or Si: more than 0.1, where the surface of the steel strip is cleaned, oxidation-treated and annealed. The treated and annealed steel strip is subsequently coated with a hot-dip coat. In order to be less cost-intensive and to achieve uniform, reproducible adhesion conditions for the coat, the steel strip is oxidation-treated prior to the annealing at temperatures below 200° C., where on the surface of the steel strip, with the formation of oxides with iron from the steel strip, an oxide layer is formed, which contains iron oxide and is reduction-treated during the course of the (Continued)

annealing under a reducing atmosphere to achieve a surface consisting substantially of metallic iron.

20 Claims, 1 Drawing Sheet

(51) Int. Cl.

| | |
|---|---|
| ***C23C 2/40*** | (2006.01) |
| ***C21D 9/56*** | (2006.01) |
| ***C21D 9/573*** | (2006.01) |
| ***C22C 38/38*** | (2006.01) |
| ***C22C 38/02*** | (2006.01) |
| ***C22C 38/06*** | (2006.01) |

(52) U.S. Cl.
CPC ..... *C21D 9/5735* (2013.01); *C22C 38/02* (2013.01); *C22C 38/06* (2013.01); *C22C 38/38* (2013.01); *C23C 2/06* (2013.01); *C23C 2/40* (2013.01)

(56) References Cited

FOREIGN PATENT DOCUMENTS

| | | | | |
|---|---|---|---|---|
| JP | 05171392 | A | * | 7/1993 |
| JP | H05171392 | A | | 7/1993 |
| JP | 05239605 | A | * | 9/1993 |
| JP | H05239605 | A | | 9/1993 |
| RU | 2367714 | C2 | | 9/2009 |
| RU | 2647419 | C2 | | 3/2018 |
| WO | 2013007578 | A2 | | 1/2013 |
| WO | 2017110054 | A1 | | 6/2017 |

OTHER PUBLICATIONS

International Search Report of the International Searching Authority from corresponding Patent Cooperation Treaty (PCT) Application No. PCT/EP2019/052191, indicated completed on Mar. 14, 2019.
Written Opinion of the International Searching Authority from corresponding Patent Cooperation Treaty (PCT) Application No. PCT/EP2019/052191, indicated completed on Mar. 14, 2019.

* cited by examiner

METHOD FOR PRODUCING A STEEL STRIP WITH IMPROVED BONDING OF METALLIC HOT-DIP COATINGS

CROSS REFERENCE TO RELATED APPLICATION

The present application claims the priority benefits of International Patent Application No. PCT/EP2019/052191, filed on Jan. 30, 2019, and claims benefit of DE 102018102624.2, filed on Feb. 6, 2018, which are hereby incorporated herein by reference in their entireties.

FIELD OF THE INVENTION

The invention relates to a method for producing a cold-rolled or hot-rolled steel strip with improved adhesion of metallic hot-dip coats.

BACKGROUND OF THE INVENTION

The following are known inter alia for the coatings or alloy coatings applied by hot-dipping: aluminium-silicon (AS/AlSi), zinc (Z), zinc-aluminium (ZA), zinc-aluminium-iron (ZF/galvannealed), zinc-magnesium-aluminium (ZM/ZAM), zinc-manganese-aluminium and aluminium-zinc (AZ). These corrosion protection coatings are typically applied to the steel strip (hot strip or cold strip) in continuous feed-through processes in a melting bath.

Patent document DE 10 2013 105 378 B3 discloses a method for producing a flat steel product which contains, in addition to iron and unavoidable impurities, the following in in wt. %: up to 35 Mn, up to 10 Al, up to 10 Si and up to 5 Cr. After heating in a pre-heating furnace to a temperature between 600 and 1000° C., in which the flat steel product is subjected to an oxidizing atmosphere at elevated temperatures, and recrystallization annealing in the annealing furnace, in which an annealing atmosphere acting in a reducing manner with respect to FeO prevails, the flat steel product is coated in the hot-dip bath.

Laid-open document DE 10 2010 037 254 A1 discloses a method for hot-dip coating of a flat steel product, wherein the flat steel product is produced from a rust-proof steel which contains, in addition to iron and unavoidable impurities, the following in wt. %: 5 to 30 Cr, <6 Mn, <2 Si and <0.2 Al. The flat steel product is heated initially to temperatures of 550 to 800° C. and at this temperature is pre-oxidized under an oxidizing pre-oxidation atmosphere, is then held under a reducing holding atmosphere and finally is guided through a melting bath.

Laid-open documents U.S. Pat. No. 2,016,010 23 79 A1 and U.S. Pat. No. 2,013,030 49 82 A1 each disclose a method for producing a coated steel strip, which contains the following in wt. %: 0.5 to 2 Si, 1 to 3 Mn, 0.01 to 0.8 Cr and 0.01 to 0.1 Al. After oxidation treatment of the steel strip at temperatures greater than 400° C. in an oxidative atmosphere, the steel strip is annealed in a reducing manner and subsequently is hot-dip coated.

Laid-open document WO 2013/007578 A2 discloses that high strength steels having higher contents of elements such as Si, Al, Mn or Cr form, during the course of the annealing of the steel strip upstream of the hot-dip coating procedure, selectively passive, non-wettable oxides on the steel surface, whereby the adhesion of the coat on the steel strip surface is impaired and this can result at the same time in the formation of non-galvanized locations. These oxides are formed by reason of the prevailing annealing atmosphere, which inevitably always contains small traces of $H_2O$ or $O_2$ and is oxidative for these elements.

The document discloses inter alia a method, in which, during the course of annealing under oxidizing conditions, in a first step pre-oxidation of the steel strip takes place, by means of which an iron oxide (FeO) layer providing targeted covering is produced, which prevents selective oxidation. In a second step, this layer is then reduced to form metallic iron.

The setting of the desired oxide layer thickness during the pre-oxidation—during the annealing—is very challenging and fault-prone in particular by reason of technically induced fluctuations or process fluctuations over the strip width and strip length. In the worst case during insufficient oxidation or reduction, this can result in local adhesion failure of the coat. Moreover, an in-line measurement of the oxide layer thickness at the process-induced high temperatures is not possible or is only possible with a great deal of outlay. Furthermore, parameters adapted to each steel are required, which makes the method even more complex. Moreover, integration into existing plants is often difficult to implement and therefore is very cost-intensive.

SUMMARY OF THE INVENTION

The invention provides a method for producing a steel strip which contains, in addition to iron and unavoidable impurities, one or more of the oxygen-affine elements of aluminium, chromium, manganese or silicon, which is less cost-intensive and provides uniform, reproducible adhesion conditions for the coat. Furthermore, an in-line measurement of the oxidation layer thickness should be possible.

The method includes producing a cold-rolled or hot-rolled steel strip with improved adhesion of metallic hot-dip coats. The steel strip, in addition to iron as the main component and unavoidable impurities, contains one or more of the oxygen-affine elements in wt. %: Al: more than 0.02, Cr: more than 0.1, Mn: more than 1.3 or Si: more than 0.1. The surface of the steel strip is cleaned and annealed. The steel strip is treated with oxidation and reduction in order to achieve a surface consisting substantially of metallic iron, and subsequently the treated and annealed steel strip is coated with a hot-dip coat. The method further relates to high strength and ultra high strength steel strip having strengths of about 500 MPa to 1700 MPa.

The steel strip is oxidation-treated prior to annealing at temperatures below 200° C., wherein on the surface of the steel strip, with the formation of oxides with iron from the steel strip, an oxide layer is formed which contains iron oxide and which is reduction-treated during the course of the annealing under a reducing atmosphere in order to achieve a surface consisting substantially of metallic iron. The oxidation treatment in accordance with the invention is independent of the process step of annealing. The ambient temperature of the steel strip corresponds to the temperature of the processing location and therefore can be given as 15° C. to 50° C.

The oxidation treatment takes place at temperatures below 200° C., preferably below 150° C., particularly preferably below 135° C. (temperatures relating in each case to the steel strip). This oxidation temperature has a lower limit preferably at room temperature in the range of 15° C. o 25° C. At these temperatures below 200° C., excessively low diffusion speeds of the elements involved in the oxidation reaction mean that no oxidation can be effected in an oxygen-containing atmosphere with a sufficient layer thickness in a cost-effective process. Starting from room temperature, the steel strip will also be heated during the oxidation treatment by means of resulting process heat, but remains below 200° C.

The steel strip used for the method in accordance with the invention advantageously has, in addition to iron and melting-induced impurities, one or more of the following oxygen-affine elements in wt. %: Al: 0.02 to 15, Cr: 0.1 to 9, Mn: 1.3 to 35 or Si: 0.1 to 10.

In a particularly advantageous manner, the steel strip has the following contents of one or more of the following oxygen-affine elements in wt. %: Al: 0.02 to 3, Cr: 0.2 to 1, Mn: 1.5 to 7, Si: 0.15 to 3 or preferably: Al: 0.02 to 1, Cr: 0.3 to 1, Mn: 1.7 to 3, Si: 0.15 to 1.

In one embodiment of the invention, provision is made that the oxidation treatment is anodic oxidation, wherein an oxide layer having a minimum thickness of at least 5 nm and of at most up to 500 nm is formed on the surface of the steel strip. Thinner layers do not result in the desired improvement in adhesion. Thicker layers demonstrate insufficient adhesion on the substrate.

The anodizing procedure can be performed either in-line upstream of the annealing furnace of a continuous hot-dip finishing plant or a continuous annealing process. However, the steps of anodizing and annealing of the method in accordance with the invention can also be performed in separate plants.

Even though the oxidation treatment in accordance with the invention is performed in an advantageous manner as anodic oxidation, other oxidation methods, such as e.g. plasma oxidation or wet-chemical methods in media which give off oxygen can basically also be used.

In another embodiment of the invention, an oxide layer is formed having a thickness of 10 nm to 200 nm on the surface of the steel strip and particularly preferably having a thickness of 30 nm to 150 nm on the surface of the steel strip.

For the anodizing procedure itself, current densities between 50 and 400 A/dm$^2$ and in a 20 to 60 wt. % NaOH solution or KOH solution at an electrolyte temperature of at least 45° C. have proven to be particularly advantageous. The electrolyte temperature is a maximum of 3 K below the boiling temperature of the electrolyte. The electrolyte can also contain, in addition to NaOH and KOH or further alkaline media, additives (e.g. complexing agents, chelate ligands, wetting agents, inhibitors, pH stabilisers) as well as unavoidable impurities on account of the incorporated components of the steel strip and the reaction products thereof.

The steel strip is actively heated by means of the electrolyte to temperatures between room temperature and 3° C. below the boiling temperature (boiling temperature of concentrated NaOH solutions is considerably above 100° C. to about 135° C.). Typically, the electrolyte has temperatures of 50° C. to 65° C.

The advantage of the oxidation treatment in accordance with the invention—prior to the annealing treatment—by means of anodic oxidation resides in the very simple and very rapid control and reliable monitoring of this method independently of the required annealing and so a very uniform layer formation and in-line measurements of the oxidation layer thickness outside the annealing furnace are possible in a problem-free manner.

The method, in accordance with the invention, gives rise to an increased spectrum of application in terms of existing methods to even more highly alloyed steels because the process-induced porous structure of the anodizing layer makes complete reduction possible even in the case of higher layer applications of the iron oxide layer because the reduction speed is hereby increased.

The annealing of the steel strip which is pre-conditioned in this manner by anodizing is performed in an advantageous manner in a continuous annealing furnace, at an annealing temperature of 650° C. to 880° C. and a heating rate of 5 K/s to 100 K/s, with a reducing annealing atmosphere, consisting of 1 to 30% $H_2$, the remainder being $N_2$, and a dew point between +15 and −70° C. and a holding time of the steel strip at annealing temperature between 30 s and 650 s with subsequent cooling to a temperature between 30° C. and 500° C. If the temperature of the strip has been cooled to below 400° C., the strip is then heated to a temperature between 400° C. and 500° C. until prior to being dipped into the metallic melting bath. Subsequently, the steel strip is hot-dip coated with the metallic coat.

The following annealing parameters have proven to be particularly advantageous: annealing temperature 750 to 850° C.; heating rate from 10 to 50 K/s; $H_2$ from 1 to 10%, the remainder being N2, and a dew point between −10 to −50° C. and a holding time of the steel strip at annealing temperature of 60 to 180 s.

DESCRIPTION OF THE PREFERRED EMBODIMENTS

Figure 1:
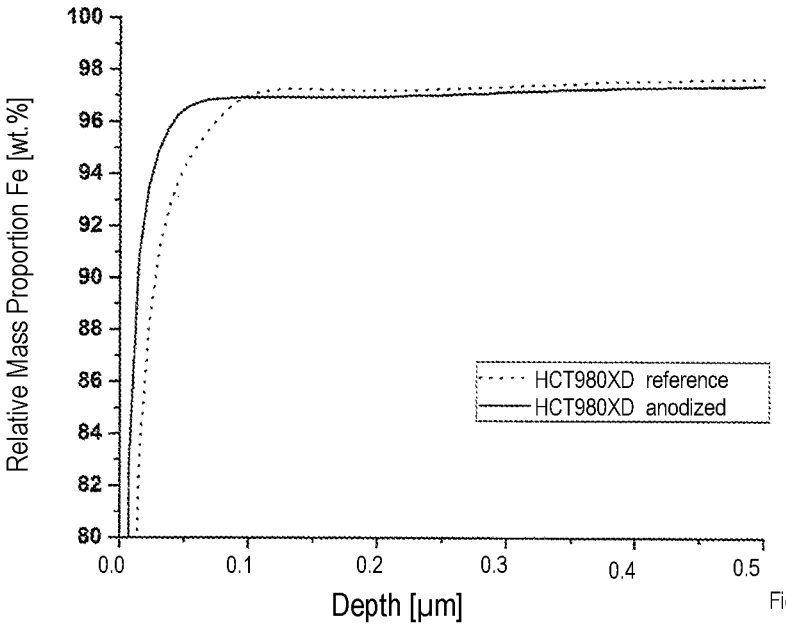
FIG. 1 illustrates a comparison of an Fe-GDOES spectrum of an anodized and subsequently reducingly annealed, non-galvanized steel sample of an HCT980XD against a spectrum of an untreated steel sample of the same grade.

FIG. 1 illustrates an Fe-GDOES spectrum of an anodized and subsequently reducingly annealed, non-galvanized steel sample of an HCT980XD (annealing conditions: 830° C., 165 s, TP −30° C.) in comparison with an untreated steel sample of the same grade. On the steel sample which is anodized, in accordance with the invention, the near-surface iron proportion in the selected conditions is significantly higher in comparison with the untreated reference sample. On the sample anodized, in accordance with the invention, the previously formed iron oxide could be completely reduced in the given conditions, even the porous structure of the freshly anodized surface is no longer observed after the annealing process. In comparison with the reference, the adhesion of the coat is improved by the previous anodizing of the sample.

Figure 2:
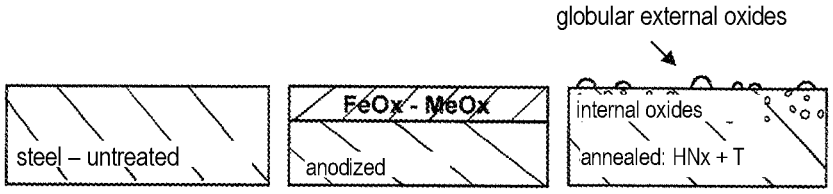
FIG. 2 is a schematic illustration of the formation of the internal and external oxides.
Figure 3:
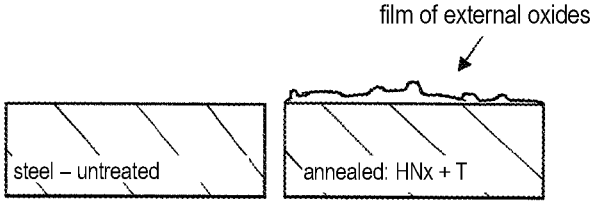
FIG. 3 is a schematic illustration of an annealing procedure prior to the hot-dip finishing.

The inventive formation of the internal and external oxides is illustrated schematically in FIG. 2. By means of the inventive anodizing with subsequent annealing in an HNx atmosphere, the formation of only a few globular external oxides is achieved. By virtue of the high proportion of metallic surface, a hot-dip finishing procedure can be performed without adversely affecting the adhesion and the surface look-and-feel. The reference process is shown in FIG. 3, which illustrates the schematic of a typical annealing procedure prior to the hot-dip finishing procedure with the formation of an almost covering external oxide layer. This disrupts the subsequent wetting to a considerable extent and results in non-galvanized locations and adhesion problems of the hot-dip coat.

By reason of the increased porosity, which can be advantageously achieved during anodizing, in comparison with thermally produced oxide layers, layers produced by anodizing can then still be reduced in the annealing furnace even in the case of higher oxide layer applications.

The hot-dip coated steel strips produced according to the method in accordance with the invention can be used preferably, but not restrictively, for producing parts for motor vehicles, such as for producing cold-formed, hot-formed or press-form-hardened components. Basically, the following are considered as coatings for the steel strips: aluminium-silicon (AS/AlSi), zinc (Z), zinc-aluminium (ZA), zinc-aluminium-iron (ZF/galvannealed), zinc-magnesium-aluminium (ZM/ZAM) or zinc-manganese-aluminium and aluminium-zinc (AZ).

In summary, when the method in accordance with the invention is applied, the following advantages are to be noted:

- improvement in galvanizing capability in particular in the case of an increased alloy content
- improvement in surface quality visually and in terms of surface defects.
- the development of new alloying concepts is accompanied by the mechanical-technological properties of the material and also by requirements of a subsequent coating. If the steel strip is to be hot-dip finished e.g. in a continuous method after annealing, then even in alloy development it is necessary to take into consideration that wettability must be present. The method in accordance with the invention allows a higher degree of freedom to be achieved in alloy development. As a result, costs can be saved in alloying or improved mechanical-technological properties can be achieved.
- possibility of measuring the oxide layer thickness prior to the annealing treatment
- homogeneous deposition of the oxide layer over the length and width of the strip
- possibility of rapid and automatic adaptation of the anodizing parameters in the event of drops in speed and a change in quality
- the emission ratio of the steel strip can be increased by the anodizing prior to the annealing process. Higher heating rates in the furnace result from this. It then possible to increase the strip speed for the same furnace length.

The invention claimed is:

1. A method for producing a steel strip containing, in addition to iron as a main component and unavoidable impurities, one or more of the following oxygen-affine elements in wt. %: Al: 0.02 or more, Cr: 0.1 or more, Mn: 1.3 or more, and Si: 0.1 or more, the method comprising:

- cleaning a surface of the steel strip;
- oxidation-treating the steel strip at temperatures below 200° C., wherein on the surface of the steel strip, with the formation of oxides with iron from the steel strip, an oxide layer is formed which contains iron oxide;
- annealing the steel strip, wherein the oxide layer which contains iron oxide is reduction-treated during the annealing under a reducing atmosphere to achieve a surface of the steel strip consisting essentially of metallic iron; and
- coating the steel strip with a hot-dip coat;
- wherein the oxide layer formed on the surface of the steel strip has a minimum thickness of at least 5 nm and of up to 500 nm.

2. The method as claimed in claim 1, wherein the oxidation: treating takes place at temperatures below 150° C.

3. The method as claimed in claim 1, wherein the annealing takes place at temperatures of 660° C. to 880° C.

4. The method as claimed in claim 1, wherein the steel strip contains one or more of the following oxygen-affine elements in wt. %: Al: 0.02 to 15, Cr: 0.1 to 9, Mn: 1.3 to 35 and Si: 0.1 to 10.

5. The method as claimed in claim 4, wherein the steel strip contains one or more of the following oxygen-affine elements in wt. %: Al: 0.02 to 3, Cr: 0.2 to 1, Mn: 1.5 to 7, and Si: 0.15 to 3.

6. The method as claimed in claim 1, wherein the oxidation: treating is anodic oxidation.

7. The method as claimed in claim 1, wherein the oxidation treating is plasma oxidation or a wet-chemical method in media which give off oxygen.

8. The method as claimed in claim 1, wherein the oxide layer formed on the surface of the steel strip has a thickness of 10 nm to 200 nm.

9. The method as claimed in claim 8, wherein the oxide layer formed on the surface of the steel strip has a thickness of 30 nm to 150 nm.

10. The method as claimed in claim 6, wherein the anodic oxidation is performed at current densities between 50 and 400 A/dm$^2$ and in a 20 to 60% NaOH solution or KOH solution at an electrolyte temperature of at least 45° C. to at most 3 K below a boiling temperature of the electrolyte.

11. The method as claimed in claim 1, wherein the annealing is performed in a continuous annealing furnace at an annealing temperature of 700° C. to 880° C. and a heating rate of 5 K/s to 100 K/s, with a reducing annealing atmosphere consisting of 2 to 30% H2 and 98 to 70% N2, and a dew point between +15 and −70° C., and a holding time of the steel strip at annealing temperature between 30 s and 650 s with subsequent cooling to a temperature between 400° C. and 500° C., and wherein the subsequent coating the steel strip comprises coating the steel strip with a metallic coat.

12. The method as claimed in claim 11, wherein the annealing temperature is 750 to 850° C., the heating rate is from 10 to 50 K/s, the annealing atmosphere has 2 to 10% H2, the remainder being N2, and a dew point between −10 to −50° C. and a holding time of the steel strip at annealing temperature of 60 to 180 s.

13. The method as claimed in claim 1, wherein coating the steel strip comprises coating the steel strip with a metallic coat, and wherein the metallic coat is chosen from at least one of: aluminum-silicon (AS/AlSi), zinc (Z), zinc-aluminum (ZA), zinc-aluminum-iron (ZF/galvannealed), zinc-magnesium-aluminum (ZM/ZAM), zinc-manganese-aluminum, and aluminum-zinc (AZ).

14. The method as claimed in claim 1, wherein the steel strip produced by the method is used for producing parts for motor vehicles or for producing press-form-hardened components of motor vehicles.

15. The method as claimed in claim 1, wherein the oxidation treatment takes place at temperatures below 135° C.

16. The method as claimed in claim 2, wherein the annealing takes place at temperatures of 660° C. to 880° C.

17. The method as claimed in claim 3, wherein the oxidation treating is anodic oxidation, and wherein the anodic oxidation is performed at current densities between 50 and 400 A/dm$^2$ and in a 20 to 60% NaOH solution or KOH solution at an electrolyte temperature of at least 45° C. to at most 3 K below a boiling temperature of the electrolyte.

18. The method as claimed in claim 17, wherein the annealing is performed in a continuous annealing furnace at an annealing temperature of 700° C. to 880° C. and a heating rate of 5 K/s to 100 K/s, with a reducing annealing atmosphere consisting of 2 to 30% H2 and 98 to 70% N2, and a dew point between +15 and −70° C., and a holding time of the steel strip at annealing temperature between 30 s and 650 s with subsequent cooling to a temperature between 400° C. and 500° C., and wherein the subsequent coating the steel strip comprises coating the steel strip with a metallic coat.

19. The method as claimed in claim 18, wherein the metallic coat is chosen from at least one of: aluminum-silicon (AS/AlSi), zinc (Z), zinc-aluminum (ZA), zinc-aluminum-iron (ZF/galvannealed), zinc-magnesium-aluminum (ZM/ZAM), zinc-manganese-aluminum and aluminum-zinc (AZ).

20. The method as claimed in claim 5, wherein the steel strip contains one or more of the following oxygen-affine elements in wt. %: Al: 0.02 to 1, Cr: 0.3 to 1, Mn: 1.7 to 3, and Si: 0.15 to 1.

* * * * *